US006902492B1

(12) United States Patent
Strand

(10) Patent No.: US 6,902,492 B1
(45) Date of Patent: Jun. 7, 2005

(54) GOLF CLUB GRIP

(76) Inventor: Allan M. Strand, 4615 W. 28th St., Minneapolis, MN (US) 55416

( * ) Notice: Subject to any disclaimer, the term of this patent is extended or adjusted under 35 U.S.C. 154(b) by 0 days.

(21) Appl. No.: 10/601,515

(22) Filed: Jun. 23, 2003

Related U.S. Application Data

(60) Provisional application No. 60/391,125, filed on Jun. 24, 2002.

(51) Int. Cl.[7] ..... A43B 53/14
(52) U.S. Cl. ..... 473/201; 473/300
(58) Field of Search ..... 473/300–303, 473/201

(56) References Cited

U.S. PATENT DOCUMENTS 4,880,240 A * 11/1989 Lewis ..... 473/215
5,779,559 A * 7/1998 Eberle ..... 473/294

FOREIGN PATENT DOCUMENTS

JP 9-206414 * 8/1997

* cited by examiner

*Primary Examiner*—Stephen Blau
(74) *Attorney, Agent, or Firm*—Haugen Law Firm PLLP

(57) ABSTRACT

A golf club grip includes a hollow tapered body having a front surface and a generally opposed rear surface defining a depth dimension therebetween, and first and second side surfaces respectively extending between and connecting the front and rear surfaces and defining a width dimension between outer extents thereof. At least the front surface of the golf club grip is planar, while the side surfaces are preferably radiused. The body includes an upper portion, an intermediate portion, and a lower portion, with the upper and intermediate portions, in combination, extending at least 60% of the body length from the second end, with at least the upper and intermediate portions of the body having a width dimension to depth dimension ratio of at least 1.1:1.

5 Claims, 2 Drawing Sheets

GOLF CLUB GRIP

CROSS-REFERENCE TO RELATED APPLICATION

This application claims priority from U.S. provisional patent application Ser. No. 60/391,125, filed Jun. 24, 2002, the contents of which are herein incorporated in their entirety.

FIELD OF THE INVENTION

The present invention relates to golf club grips generally, and more particularly to novel golf club grip geometries providing enhanced stability and comfort in the user's hand, thereby improving the efficacy of the golf club, particularly that of a putter.

BACKGROUND OF THE INVENTION

Golf club grips, and particularly grips of golf putters, are configured in a variety of geometries in an attempt to provide a comfortable grip which assists the user in engaging the golf club and moving the golf club in such a manner so as to strike and direct a golf ball in an intended and correct fashion. In particular, it is critically important in a golf putter to strike the ball squarely with respect to the intended line of travel of the golf ball. In addition, it is important that the golf club be stable in the user's hands such that the golf club directly follows, and is consistent with the motion of the user's arms. Such characteristics are particularly important in the golf putter so that a desired level of golf ball projection consistency is achieved from the user's swing. Such consistency leads to the enhancement of a particular user's skill level in playing golf.

It is therefore a principle object of the present invention to provide an improved golf club grip having a geometry specifically configured to enhance the stability of the golf club when operated by the user.

It is another object of the present invention to provide an improved golf club grip particularly adapted for use with a golf putter.

It is a further object of the present invention to provide an improved golf club grip with an upper portion thereof having two opposed sides disposed in divergent relationship to one another.

It is a still further object of the present invention to provide an improved golf club grip having four sides, with a first pair of opposed sides each having substantially planar surfaces, and a second pair of opposed sides having radiused outer surfaces connecting the first pair of opposed sides.

It is a yet further object of the present invention to provide an improved golf club grip having a width and a depth, the width being defined by a dimension extending substantially perpendicular to the face of the golf club, and generally parallel to the direction of travel imparted upon the golf ball, with the width to depth ratio being at least about 1.10 to 1.

It is a still further object of the present invention to provide an improved golf club grip having a tapered width profile, such that the width to depth ratio increases from a bottom portion to a top portion of the grip.

It is another object of the present invention to provide an improved golf club grip with a top portion thereof having a width to depth ratio of at least about 2 to 1.

SUMMARY OF THE INVENTION

By means of the present invention, a golfer is provided with a golf club grip configuration which enhances both feel and stability in the user's hands during the golf swing. Such stability results in enhanced consistency of relative motion between the golf club and the user's hand during the swing. As a result, the golf club grip of the present invention acts to enhance the respective user's level of play.

In a particular embodiment of the present invention, the golf club grip includes a hollow tapered body having a first open end and a second substantially closed end defining a body length therebetween, a front surface and a generally opposed rear surface, and first and second side surfaces respectively extending between and connecting the front and rear surfaces. The body is specifically adapted to be mounted on a golf club shaft by operably inserting the shaft into the open end of the body such that the front surface is disposed generally away from the user and toward a golf ball striking portion of the golf club when the club is used in typical fashion. The front surface is generally planar and the side surfaces are radiused. The body includes a width dimension and a depth dimension, with the depth dimension being defined between the front and rear surfaces, and the width dimension being defined between respective outer extents of the first and second side surfaces. The body further includes an upper portion, an intermediate portion, and a lower portion, with the upper, intermediate, and lower portions, in combination, extending throughout the body length. The upper and intermediate portions, in combination, extend at least 60% of the body length from the second end, and at least the upper and intermediate portions have a width dimension to depth dimension ratio of at least 1.1:1.

Preferably, the upper portion has a tapered width profile, such that a width to depth ratio of the upper portion increases from about 1.1:1 to about 2.5:1.

DETAILED DESCRIPTION OF THE PREFERRED EMBODIMENTS

The objects and advantages enumerated above together with other objects, features, and advances represented by the present invention will now be presented in terms of detailed embodiments. Other embodiments and aspects of the invention are recognized as being within the grasp of those having ordinary skill in the art.

Figure 1:
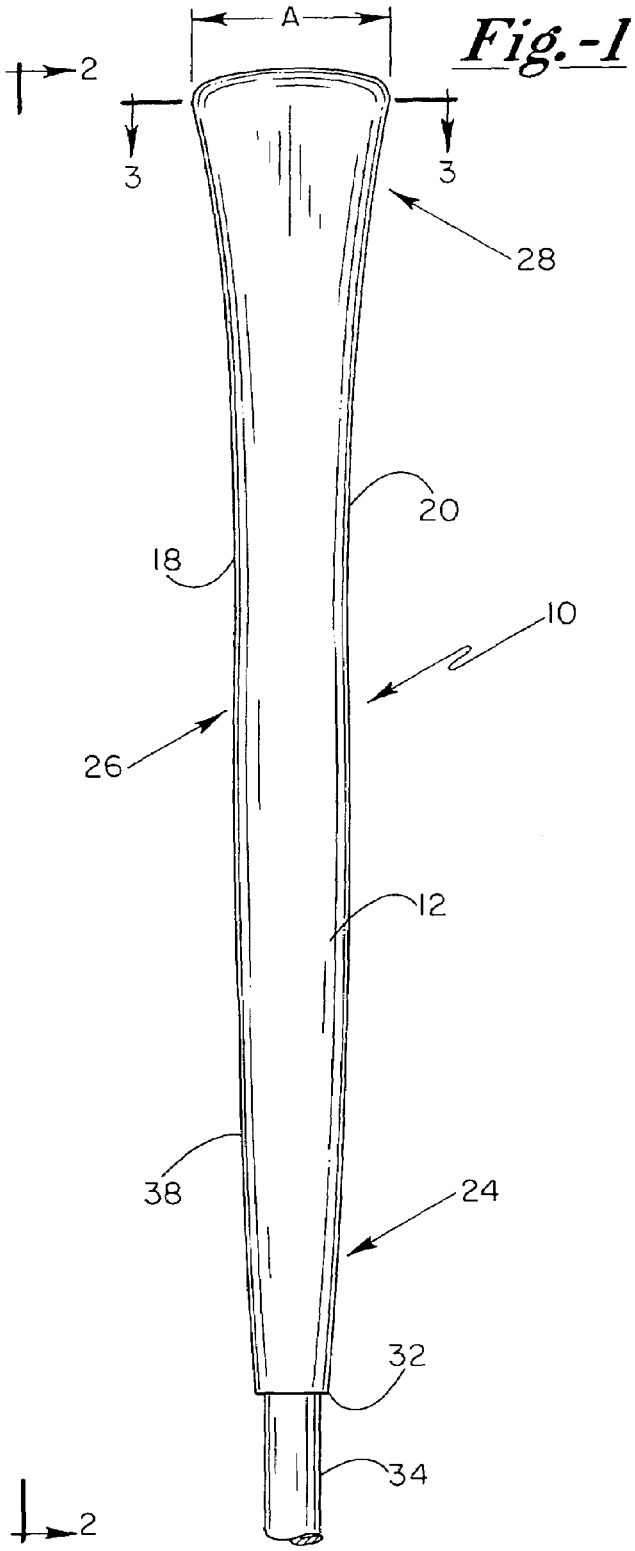
FIG. 1 is a front elevational view of a golf club grip of the present invention.
Figure 2:
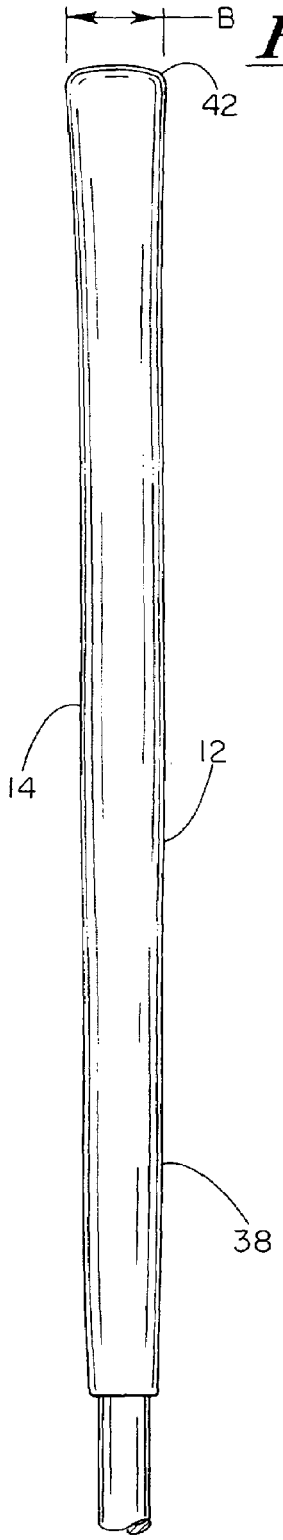
FIG. 2 is a side view of a golf club grip of the present invention illustrated in FIG. 1.

With reference now to the drawing figures, and first to FIG. 1, a front view of a golf club grip 10 of the present invention is shown. Front surface 12 of grip 10 is preferably disposed toward and in facing relationship with the golf club head (the golf ball striking portion of the golf club), and is disposed generally away from the body of a user when the golf club is being utilized in typical fashion. As can be seen more easily in the side view of FIG. 2, front surface 12 and opposed rear surface 14 are substantially planar, and are connected to one another by first and second side surfaces 18, 20.

As shown in FIG. 1, grip 10 includes a lower portion 24, an intermediate portion 26, and an upper portion 28. Lower portion 24 of grip 10 is tapered inwardly toward lower end 32 to accommodate and tightly fit about a typical golf club shaft 34. Preferably, lower portion 24 tapers such that the width "A" of grip 10 at first inflection point 38 is greater than depth "B" thereat. Preferably, width A of grip 10 is greater than depth B from first inflection point 38 to top end 42 of grip 10.

Figure 3:
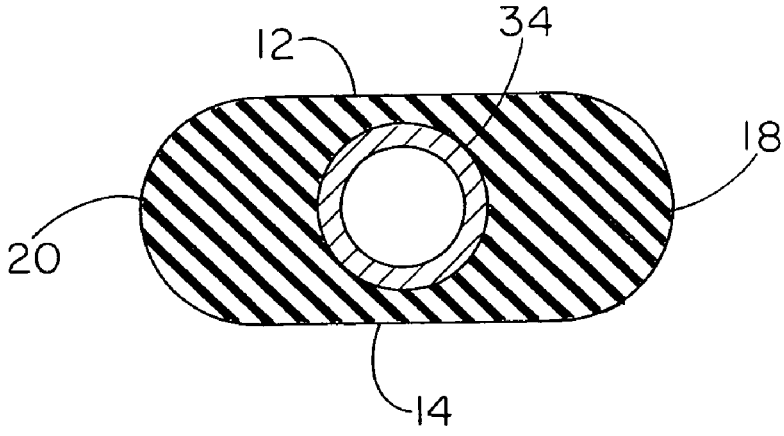
FIG. 3 is a top cross-sectional view of the golf club grip of the present invention illustrated in FIG. 1.

First and second side surfaces 18, 20 are preferably radiused such that a cross-section of grip 10, as illustrated in the top view of FIG. 3, reveals substantially flat front and rear surfaces 12, 14 connected by substantially semi-circular radiused first and second side surfaces 18, 20. Preferably, first and second side surfaces 18, 20 are substantially symmetrical, and maintain a substantially constant depth dimension B throughout the length of grip 10. Most preferably, however, depth dimension B of first and second side surfaces 18, 20 gradually increases from bottom end 32 to top end 42 of grip 10. Such depth dimension B is preferably between about 0.5 and 1.0 inches, and more preferably between about 0.5 and 0.875 inches.

Width A of grip 10 preferably increases from lower end 32 to first inflection point 38, and is substantially constant from first inflection point 38 to second inflection point 44. Most preferably, however, width A increases slightly from first inflection point 38 to second inflection point 44. Intermediate portion 26 is defined as the portion of grip 10 between first inflection point 38 and second inflection point 44. Width A of intermediate portion 26 is preferably between 0.75 and 1.0 inches. Preferably, width A is greater than depth B at intermediate portion 26, and the ratio of width A to depth B at intermediate portion 26 is preferably between about 1.1:1 and about 1.5:1.

A preferred aspect of the present invention includes a "flared", or divergently tapered upper portion 28 defined between top end 42 and second inflection point 44 of grip 10. As illustrated in FIG. 1, width dimension A substantially increases from second inflection point 44 to top end 42. In such a manner, first and second side surfaces 18, 20 extend upwardly in a divergent manner with respect to one another. Preferably, width A increases to between about 1.3 and 1.7 inches at top end 42. Moreover, the ratio of width dimension A to depth dimension B increases from second inflection point 44 to top end 42, such that a A:B ratio increases from between about 1.1:1 to about 2.5:1, and most preferably from between about 1.3:1 to about 2.2:1.

In preferred embodiments of the present invention, changes in width dimension A along grip 10 are subtle in that first and second inflection points 38, 44 are best described as transition zones whereby no sharp or readily perceivable points at which width dimension A changes exist.

Grip 10 is preferably fabricated from materials known and commonly utilized in the art. Most preferably, however, grip 10 is fabricated from a resilient polymeric material having a desired degree of tackiness at its outer surface. In addition, the present invention contemplates a variety of configurations related to that illustrated and described in FIGS. 1–3. For example, rear surface 14 of grip 10 may be rounded or radiused rather than planar, as described with reference to FIGS. 1–3. In such an embodiment, the radius of rear surface 14 preferably conforms to the curvature of respective first and second side surfaces 18, 20, such that a substantially continuously curved surface is formed by the combination of rear surface 14 and first and second side surfaces 18, 20.

In another embodiment of the present invention, first and second side surfaces 18, 20 may be asymmetrical in that one of first or second side surfaces 18, 20 at upper portion 28 is not outwardly flared as is shown in FIG. 1. Thus, a variety of configurations may be incorporated into grip 10 of the present invention without departing from the advantages introduced thereby.

As stated above, a number of advantages are introduced by the golf club grip of the present invention. For example, the substantially planar nature of opposed front and rear surfaces 12, 14 provide a natural self-orienting characteristic for the hands of a user. The opposed rounded first and second side surfaces 18, 20 provide a comfortable and secure fit within the palms of the user. The primary advantage of enhancing golf club "feel" by improving the stability of a user's grasp of the golf club, thereby improving the consistency in the manner that the golf ball is struck by the golf club. In particular, the larger than unity width to depth ratio of grip 10, in combination with the divergent relationship with side surfaces 18, 20 at upper portion 28 provides the unique and advantageous grip feel not obtainable in golf club grips in use today.

The invention has been described herein in considerable detail in order to comply with the patent statutes, and to provide those skilled in the art with the information needed to apply the novel principles and to construct and use embodiments of the invention as required. However, it is to be understood that various modifications can be accomplished without departing from the scope of the invention itself.

What is claimed is:

1. A golf club grip configured for operable engagement with a golf club shaft, said grip comprising:

a hollow tapered body having a first open end and a second substantially closed end defining a body length therebetween, and a front surface and a generally opposed rear surface, and first and second side surfaces respectively extending between and connecting said front and rear surfaces, said body being specifically adapted to be mounted on such golf club shaft by operably inserting the shaft into said open end of said body such that said front surface is disposed generally away from the user and toward a golf ball striking portion of the golf club when the club is used in typical fashion, said front surface being generally planar and said side surfaces being radiused, said body having a width dimension and a depth dimension, the depth dimension being defined between said front and rear surfaces, and the width dimension being defined between respective outer extents of said first and second side surfaces, said body including an upper portion, an intermediate portion, and a lower portion, said upper, intermediate, and lower portions, in combination, extending throughout said body length, with said upper and intermediate portions, in combination, extending at least 60% of said body length from said second end, at least said upper and intermediate portions having a width dimension to depth dimension ratio of at least 1.1:1, said upper portion having a tapered width profile, such that a width to depth ratio of said upper portion increases between a first inflection point at an intersection between said upper portion and said intermediate portion, and said second end from about 1.1:1 to about 2.5:1.

2. A golf club grip as in claim 1 wherein said rear surface is substantially planar.

3. A golf club grip as in claim 2 wherein respective planes defined by said front and rear surfaces are substantially parallel to one another.

4. A golf club grip as in claim 1 wherein the width to depth ratio of said tapered body increases from a second inflection point at an intersection between said lower portion and said intermediate portion, to said second end.

5. A golf club grip as in claim 1 being particularly adapted for use with a golf putter.

* * * * *